US005311822A

United States Patent [19]

Bounds

[11] Patent Number: 5,311,822

[45] Date of Patent: May 17, 1994

[54] BALLAST HOPPER DOOR CONTROL APPARATUS AND METHOD WITH INDEPENDENTLY AND SELECTIVELY ACTUATED MOTORS IN RESPONSE TO UNIQUELY CODED SIGNALS

[75] Inventor: Ivan E. Bounds, St. Joseph, Mo.

[73] Assignee: Herzog Contracting Corporation, St. Joseph, Mo.

[21] Appl. No.: 986,600

[22] Filed: Dec. 7, 1992

[51] Int. Cl.[5] ..... B61D 7/30

[52] U.S. Cl. ..... 105/311.1; 105/240; 105/241.2; 105/283; 222/504

[58] Field of Search ..... 105/240, 241.2, 280, 105/283, 286, 311.1; 222/504; 298/24, 31, 35 M

[56] References Cited

U.S. PATENT DOCUMENTS

| | | | |
|---|---|---|---|
| 2,989,930 | 6/1961 | Flowers | 105/248 |
| 3,191,944 | 6/1965 | Watts | 222/504 X |
| 3,295,704 | 1/1967 | Gillick et al. | 105/311.1 X |
| 3,371,826 | 3/1968 | Speno | 105/240 |
| 3,446,373 | 5/1969 | Keister, Jr. et al. | 105/240 X |
| 3,596,565 | 8/1971 | Atkinson | 105/240 X |
| 3,654,872 | 4/1972 | Fearon | 105/239 |
| 3,682,332 | 8/1972 | Fearon | 414/400 |
| 3,701,320 | 10/1972 | Fearon et al. | 104/6 |
| 3,717,110 | 2/1973 | Miller | 105/284 |
| 3,822,650 | 7/1974 | Fearon | 105/239 |
| 3,838,649 | 10/1974 | Barnard | 105/240 |
| 3,877,384 | 4/1975 | Fearon et al. | 104/6 |
| 4,009,664 | 3/1977 | Fearon | 105/239 |
| 4,325,308 | 4/1982 | Erfurth | 105/280 |
| 4,359,176 | 11/1982 | Johnson | 105/240 |
| 4,601,244 | 7/1986 | Fischer | 105/240 |
| 4,766,820 | 8/1988 | Ritter | 105/240 |
| 5,038,966 | 9/1991 | Olk | 105/282.1 X |
| 5,115,748 | 5/1992 | Westlake | 105/286 |
| 5,144,895 | 9/1992 | Murray | 105/286 |

FOREIGN PATENT DOCUMENTS

| | | | |
|---|---|---|---|
| 930612 | 7/1973 | Canada . | |
| 724378 | 3/1980 | U.S.S.R. | 105/311.1 |

*Primary Examiner*—Robert J. Oberleitner
*Assistant Examiner*—S. Joseph Morano
*Attorney, Agent, or Firm*—Litman, McMahon & Brown

[57] ABSTRACT

A ballast hopper car door control apparatus and method for controlling a pivoting hopper discharge control member on a railroad ballast car or the like, includes a drive shaft extending through the discharge control member at the pivot point. A transmission is connected to the drive shaft and is driven by a reversible electric motor. The motor is controlled via a radio receiver which receives motor control signals from a remote radio transmitter. When there are a plurality of ballast cars on a train, each car has a receiver which responds to a different address sequence. The remote transmitter is operable to selectively send any of the different address sequences so that a single selected car can be remotely controlled. Multiple hoppers on a single car are controllable by a single receiver.

18 Claims, 3 Drawing Sheets

BALLAST HOPPER DOOR CONTROL APPARATUS AND METHOD WITH INDEPENDENTLY AND SELECTIVELY ACTUATED MOTORS IN RESPONSE TO UNIQUELY CODED SIGNALS

BACKGROUND OF THE INVENTION

The invention relates to a hopper door opening control apparatus and method for controlling a hopper discharge control member on a railroad ballast car.

Railroad ballast has traditionally been discharged and/or spread by specially designed hopper cars called "ballast cars". In such cars, the ballast is discharged through hopper doors positioned beneath the hopper. When such doors are positioned directly beneath the car, ballast discharged therefrom must be spread by hand, a labor intensive task, or by an additional specially equipped railroad car.

These problems were addressed in U.S. Pat. No. 3,654,872 ('872 patent) in which a ballast car has four hoppers, each of which is provided with a bottom-mounted discharge opening with a discharge control member inserted therein. The discharge openings are centered over a rail and each discharge control member is a pivotable structure with a pair of side walls extending at an angle outward from an arcuate top surface. A bottom wall connects the side walls and a pair of end walls extend past the side walls to form channels on either side of the discharge control member. The discharge control member is attached at a pivot point positioned below the discharge opening. The arcuate top surface covers the discharge opening when the discharge control member is pivoted to a center position. When the discharge control member is pivoted to one side or the other, the discharge opening is partially opened and ballast is released through the channel formed by one of the angled side walls and the end walls and is thus directed to an associated side of the railroad rail. By selectively pivoting the discharge control member, a proper amount of ballast is directed to a desired position which minimizes or eliminates subsequent spreading requirements. On ballast cars containing pairs of side-by-side hoppers, ballast can be selectively distributed inside or outside of each rail to further minimize spreading requirements.

While representing a significant improvement over prior ballast hopper cars, the hopper car door discharge control member in the '872 patent is controlled by a hand-operated lever. Thus, the control opening or openings on each ballast car must be set by hand when the train is stationary and can not be adjusted once the train is in motion.

It is clear that a need exists for an improved ballast car hopper door control apparatus and method which is power driven and which is remotely controllable to allow adjustment while a train including the ballast car is in motion. Such an apparatus and method should also provide for the selective adjustment of any one ballast car in a train carrying multiple ballast cars and of multiple hoppers on a single ballast car.

SUMMARY OF THE INVENTION

The present invention is a remotely controlled power hopper door control apparatus and method for a railroad ballast car or the like. The apparatus comprises a conventional pivotable discharge control member, as taught by the '872 patent, which member is pivotally mounted in a hopper door discharge opening located beneath a hopper on the ballast car. A drive shaft extends through the discharge control member at the pivot point and a sealed gear-driven transmission is attached to one end of the drive shaft. A reversible electric motor is connected to the transmission via a reduction gear to drive the transmission, and thus the drive shaft, in either direction. The motor is controlled by relays which are, in turn, selectively operated by a radio receiver. A remote radio transmitter and control keyboard is adapted to send selected control command signals to the receiver. These commands include IN and OUT and emergency stop control signals.

In addition, different ballast cars in a single train are equipped with receivers responsive to different address sequences. The remote radio transmitter includes a numeric keyboard which is operable to select different ones of said address sequences and thus to control different ballast cars in the same train. Multiple hoppers on a single car are also selectively controllable as well.

OBJECTS AND ADVANTAGES OF THE INVENTION

The principal objects of the present invention are: to provide an improved railroad ballast car hopper door control apparatus and method; to provide such an apparatus and method in which a reversible electric motor drives a transmission; to provide such an apparatus and method in which a drive shaft is connected to the transmission and extends through a pivot point of a pivoting discharge control member; to provide such an apparatus and method in which the discharge control member selectively covers the hopper door opening or discharges ballast from either side of the hopper door opening; to provide such an apparatus and method in which the motor is controlled by relays selectively operated by a radio receiver; to provide such an apparatus and method in which a remote radio transmitter and keyboard is adapted to send control signals to the radio receiver to control the electric motor; to provide such an apparatus and method in which different ballast cars in a train have receivers responsive to different address sequences; to provide such an apparatus and method in which the remote transmitter is selectively controllable to transmit different ones of said address sequences so that individual ballast cars in the train are separately controllable; to provide such an apparatus and method in which a single ballast car can include multiple hopper door openings; to provide such an apparatus and method in which multiple pivoting discharge control members on a single ballast car are controlled by a single receiver; and, to provide such an apparatus and method which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
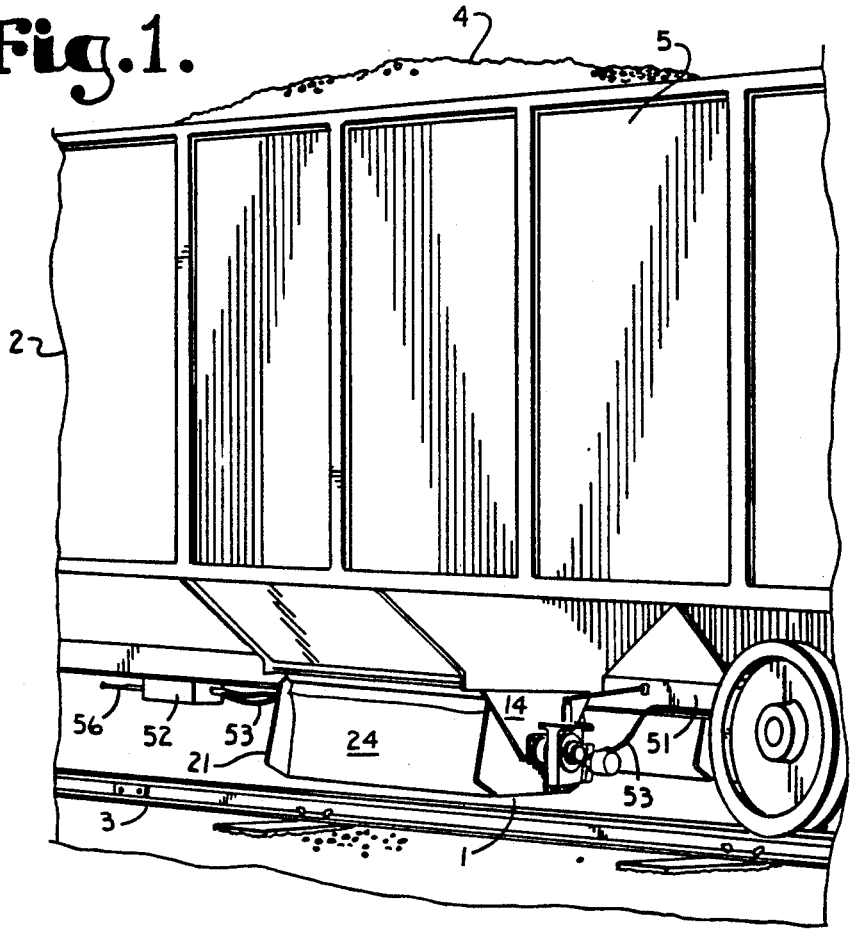
FIG. 1 is a fragmentary perspective view of a railroad ballast car equipped with a hopper door control apparatus according to the present invention.
Figure 2:
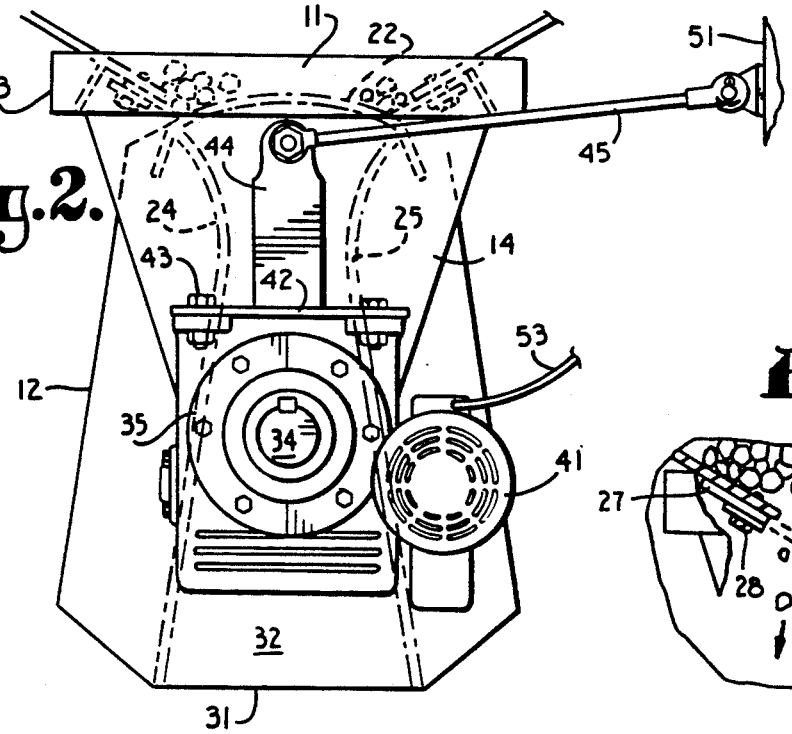
FIG. 2 is an enlarged end view of the hopper door control apparatus with the angled side walls and the arcuate top of the discharge control member shown partially in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limited, but merely as a basis for the claims and as a representative basis for teaching one skilled in the art to variously employ the present invention in virtually any appropriately detailed structure.

Referring to FIGS. 1-5, a hopper door control apparatus, generally referenced as 1, is shown in conjunction with a railroad ballast hopper car 2 operating on a pair of railroad rails 3. The car 2 is shown with a load of railroad ballast 4, which usually comprises fine gravel, cinders or the like, for distribution between and on either side of the railroad rails 3.

Typically, the ballast car 2 will include up to 4 separate hoppers 5, each of which has a bottom discharge opening 11. At the bottom of each hopper discharge opening 11 is positioned a ballast discharge control assembly 12. For convenience, only one such opening 11 is illustrated in FIGS. 1, 2, 3 and 5, since each such opening 11 and discharge control assembly 12 is identical.

The discharge control assembly 12 comprises an open top frame member 13 which is placed adjacent to and surrounding the hopper discharge opening 11. A pair of opposed triangular shaped end support plates 14 and 15 are attached at either end of the open frame member 13. A pivoting discharge control member 21 comprises an arcuate top surface 22 with a radius approximately equal to the distance from a pivot point 23 on the end support plates 14 and 15, to the lower end of the discharge opening 11. The arcuate top surface 22 covers the entire discharge opening 11 when the discharge control member 21 is pivoted to a center position to prevent discharge of any of the ballast material 4. A pair of side walls 24 and 25 extend outward from the arcuate top surface 22, with the side walls connected together by a bottom wall 31 and a pair of end walls 32 and 33. The end walls 32 and 33 extend past the side walls 24 and 25 to channel discharged ballast along each of the side walls 24 and 25, thus forming gravity chutes. Each end wall 32 and 33 of the discharge control member 21 is rigidly attached to a pivoting drive shaft 34 (FIG. 5), which extends through openings in both end support plates 14 and 15 and which is attached thereto by a pair of support plates 36 and 37, respectively. A transmission gear assembly 35 is connected to the drive shaft 34 and to a reversible electric motor 41. The motor 41 is operative to turn the drive shaft 34 via a reduction gear assembly (not shown) in the transmission 35. The transmission 35 is bolted onto a horizontal support plate 42 via a plurality of bolt and nut assemblies 43. The horizontal support plate 42 is attached to a vertical support plate 44 which is supported by a rod 45 attached at one end to the top of the support plate 44 and pivotally attached at the other end to a frame member 51 on the railroad car 2.

Figure 4:
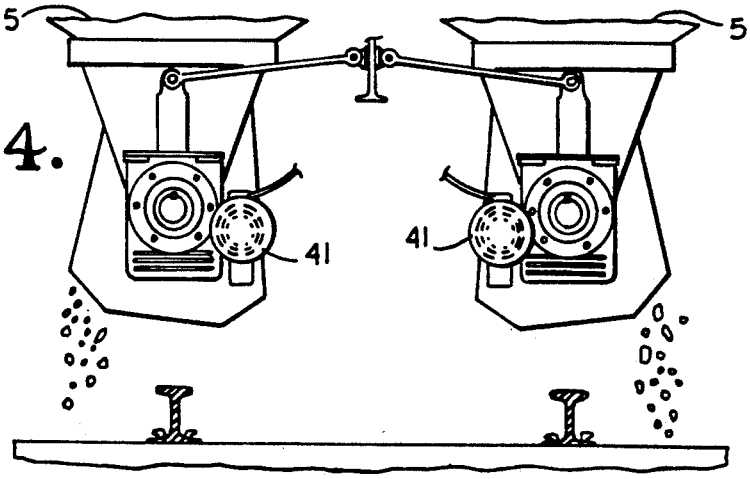
FIG. 4 is an enlarged end view of a pair of hopper door control apparatuses mounted on a ballast car with a set of railroad tracks shown beneath them.
Figure 5:
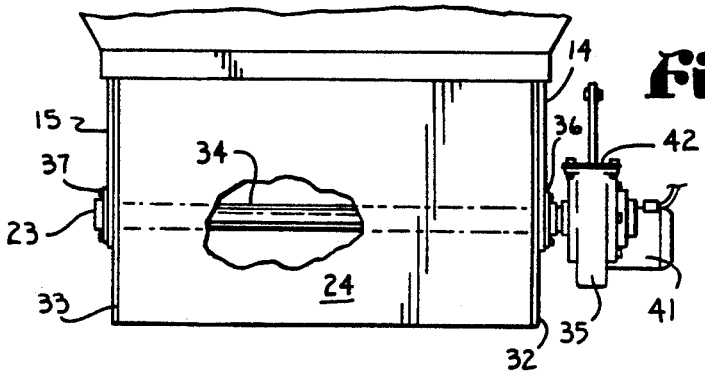
FIG. 5 is an enlarged side elevational view of the discharge control member, transmission and motor, with portions broken away to illustrate the drive shaft.

A single radio receiver 52 (FIG. 1) is mounted on the railroad car 2 in a position which permits radio reception to an antenna 56 with minimal interference from the body of the car 2. The receiver 52 is a conventional receiver capable of receiving an RF signal and decoding a digital address and control signal modulated thereon. Each car 2 has up to four hoppers 5, (two of which are shown in FIG. 4) each of which has a discharge opening 11 and a discharge control assembly 12 including a motor 41. Each motor 41 is connected to the radio receiver 52 via a control and power supply cable 53. The radio receiver 52 can selectively control any of the reversible motors 41 to operate in either direction, thus opening or closing a gap on either side of the associated discharge opening 11. Control of each individual motor 41 is via a pair of conventional corresponding relays 71-78 in a relay bank 70 (FIG. 7) which selectively power the motor or motors 41 in one direction or the other.

Figure 3:
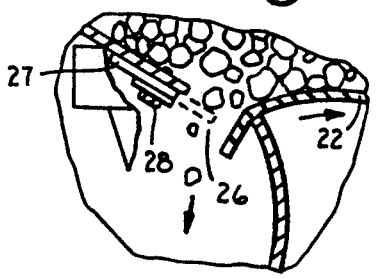
FIG. 3 is an enlarged fragmentary view of the discharge control member pivoted clockwise to partially open the hopper door.

FIG. 3 depicts one side of the discharge opening 11 with the discharge control member 21 pivoted in the direction of the arrow, this opening a gap 26 between the adjustable steel plate 27 and the arcuate top surface 22. The ballast 4 is thus gravity fed through the gap 26 and along the channel defined by the side wall 24 and the end walls 32 and 33. As the discharge control member 21 is pivoted further to the right, the gap 26 is widened, thus allowing a greater volume of the ballast 4 to be fed through. The adjustable steel plate 27, which can be an inch thick, is adjustable via slots in the plate (not shown) which engage a bolt 28 attached to the hopper 5. The plate 27 is shown in an extended position in phantom lines.

Figure 6:
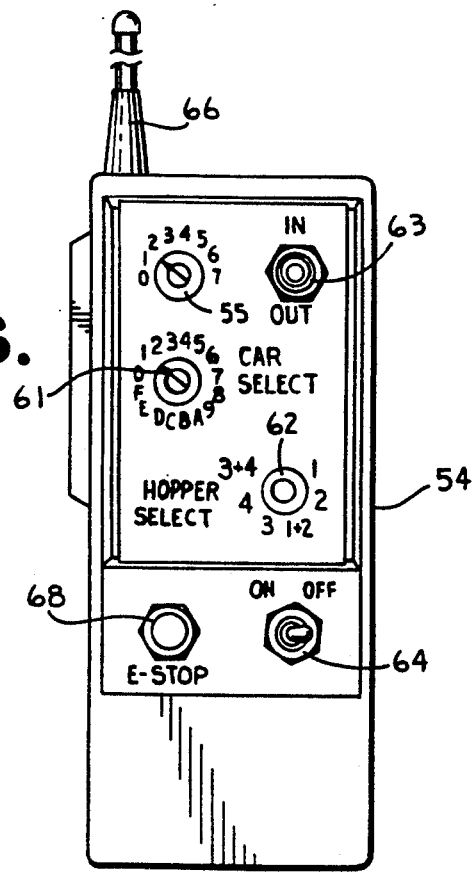
FIG. 6 is a frontal view of a remote control transmitter and keyboard.
Figures 7, 8, 9:
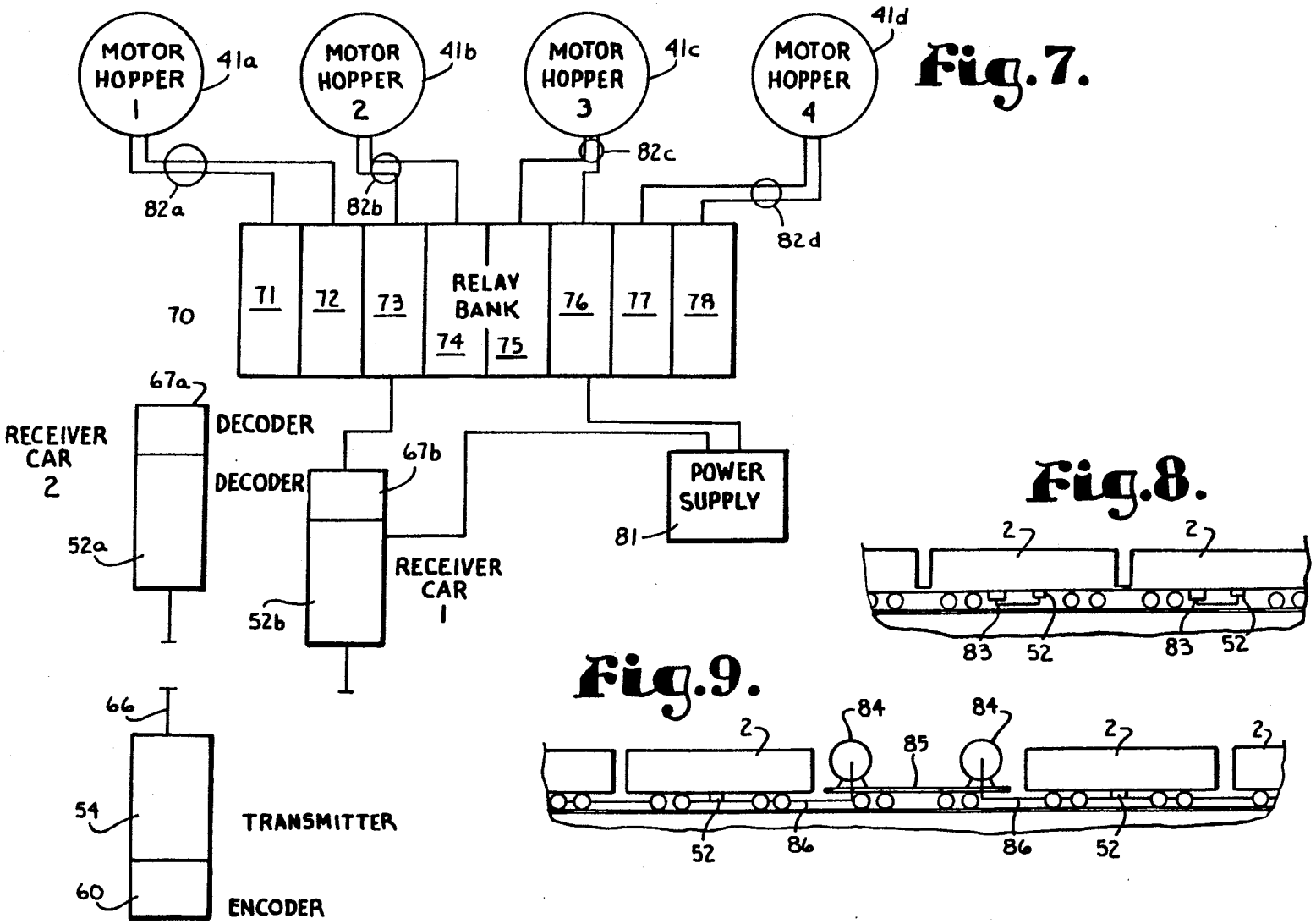
FIG. 7 is a block electrical schematic diagram of a hopper door control system.
FIG. 8 is a reduced side-elevational view of a portion of a train with individual batteries used as hopper door control power supplies.
FIG. 9 is a reduced side-elevational view of a portion of a train with common generators used as hopper door control power supplies.

FIG. 6 illustrates a front control panel for a remote radio control transmitter 54. FIG. 7 is a block electrical schematic of the transmitter 54 with a pair of remote receivers 52*a* and 52*b*. The receiver 52*b* for car 1 is shown complete with a relay bank 70 including eight control relays 71-78. It should be understood that each receiver 52 controls a similar relay bank 70, and that there are as many receivers 52 as there are ballast hopper cars 2 in a train.

Referring to FIGS. 6 and 7, a pair of rotary switches 55 and 61 are operative to select a remote receiver 52 on a particular hopper car 2 in a train of such cars. The selection can be accomplished by, for example, encoding and transmitting a unique digital address via an encoder 60 connected to the transmitter 54 to which only the selected receiver 52 will respond. A third rotary switch 62 is for selecting a particular hopper or pair of hoppers 5 on the selected car 2. As shown in FIG. 4, a pair of the hoppers 5 can be jointly controlled for dumping ballast inside or, alternatively, outside of the rails 3. An IN/OUT toggle switch 63 is used to send an "IN" or "OUT" signal to pivot the selected discharge control member to the inside or the outside of the rails 3. An ON/OFF switch 64 is provided for the transmitter 54 and an Emergency Stop switch 65 sends a stop signal to the selected receiver 52. The receiver 52 then immediately stops all motors 41 on the selected car 2. An RF antenna 66 is mounted on the transmitter 54.

The selected receiver 52 with an associated decoder 67, which is assumed to be the receiver **52*b* and decoder 67*b* of car 1 in FIG. 7, causes one or more of the relays 71–78 to connect power from a power supply 81 to a selected one of or a pair of the motors 41*a*–41*d*. Each of the motors 41*a*–41*d* is connected via a respective wire pair 82*a*–82*d* to a pair of the relays 71–78. For example, the motor 41*a* in hopper 1 is connected to relays 71 and 72. Depending upon which direction of rotation is selected by the IN/OUT toggle switch 63, the relay 71 or the relay 72 is enabled to selectively switch power to the motor 41*a* to cause it to rotate in the selected direction. If a pair of the hoppers 5 are selected via the hopper select switch 62, then a pair of the relays 71–78 are enabled by the addressed receiver 52*b***.

Digital signalling from the transmitter 54 to the selected receiver 52 can be accomplished by any conventional digital coding technique which modulates an RF signal. Pulse width modulation is one of several suitable signalling schemes.

FIGS. 8 and 9 are alternative illustrations of power supply sources for a train containing multiple hopper cars 2, each of which includes a receiver 52 attached thereto. In FIG. 8, each hopper car 2 includes a self-contained battery 83 for powering the receivers 52 and associated relays 71–78 and motors 41. In FIG. 9, a common generator 84, or a pair of such generators 84, are carried on a special car 85, with a common power supply cable 86 providing power to each ballast hopper car 2. Of course, generator power can be provided from a locomotive (not shown) or another common generator source as well.

The operation of the hopper control apparatus 1 will now be described with reference to FIGS. 1–7. A train including a plurality of the ballast hopper cars 2 is positioned onto a pair of the rails 3 which need additional ballast. As the train moves along the rails 3, the first hopper car 2 in the train is selected remotely by an operator, who, for example, may be stationed in the locomotive, by operating the rotary switches 55 and 61 on the transmitter 54. Operation of the correct rotary switch combination causes the transmitter 54 to attach a digitally coded address to any subsequent control message. When the correct car 2 is selected via the rotary switches 55 and 61, the correct hopper 5 and the desired discharge direction must be selected. If, for example, ballast 4 is needed on the outside of both of the rails 3, the rotary hopper select switch 62 is turned to the Nos. 1+2 position. The IN/OUT toggle switch 63 is then flipped to the OUT position and held for a set time. This combination of rotary switch positions for the switches 55, 61 and 62 and the pushing of the toggle switch 63 causes the transmitter 54 to send a digitally encoded signal which includes a leading receiver address sequence and a motor control signal to cause the selected receiver **52*b* to enable the relays 71–74 to control the motors 41*a* and 41*b* in the hoppers 1+2 in a manner to turn the discharge control members 21 in the selected hoppers 5 outward. The receiver 52*b* in car 1 recognizes the lead address and responds to the digital signal in the desired fashion. As long as the IN/OUT toggle switch 63 is held in the OUT position, the digital signal is repeated and the motors 41*a* and 41*b* are continuously turned in the selected direction. When the toggle switch 63 is released, the digital control signal ceases and the relays 71–74 are opened, stopping the motors 41*a* and 41*b*, with the discharge control members 21 held in the selected position. Ballast 4 is thus distributed along the outside of the rails 3 as the train moves. When the selected Nos. 1+2 hoppers 5 on the selected car 2 are empty, the rotary switch 62 is turned to the No. 3+4 position and the IN/OUT toggle switch 63 is again toggled to OUT for a set period. The receiver 52*b* in car 1 thus controls the relays 75–78 in a fashion which causes the motors 41*c* and 41*d* in hoppers 3+4 to turn outward. Similarly, when all four of the hoppers 5 on the first car 2 in the train are empty, the receiver 52*a* in the second car is selected via the rotary switches 55 and 61 and the process is repeated. If ballast 4 is needed on only one side of one of the rails 3, only one of the four hopper motors 41*a*–41*d* is selected and controlled accordingly, and, conversely, if ballast 4 is needed both inside and outside both of the rails 3, the discharge control members 21 on hoppers 1+2 can be pivoted outward while the control members 21 on hoppers 3+4 are pivoted inward, thus distributing ballast 4 inside and outside of both of the rails 3**.

In a preferred embodiment, the motor 41 and transmission 35 was a Gearmotor by Helical-Bevel Corp., the pivoting discharge control member 21 was a Ballast Door Size C-45 by Morrison-Knudsen Corp., and the radio transmitter 54 and receiver 52 combination was a CATTRON CAT-824E-01 by Cattron, Inc. operating in a frequency range of 450–470 MHz, in which up to 126 unique addresses can be transmitted for each RF channel.

While a digital address signalling scheme has been described for selecting individual cars on a train, it should be apparent that utilizing different carrier or modulating frequencies for each car, or any other suitable manner of selecting individual receivers from a group of such receivers could be employed as well.

It is to be understood that while certain forms of the present invention have been illustrated and described herein, it is not to be limited to the specific forms or arrangement of parts described and shown.

What is claimed and desired to be secured by Letters Patent is as follows:

1. On a train including a plurality of railroad cars, each car including a plurality of hopper discharge openings and pivoting discharge control members, a hopper door control apparatus for controlling said pivoting discharge control members, comprising:

(a) a drive shaft extending lengthwise through each said discharge control member at the pivot point;

(b) a reversible electromechanical power source connected to each said drive shaft to selectively drive said drive shaft in a clockwise or a counter-clockwise direction;

(c) a receiver on each car connected to the respective power sources on that car and adapted to selectively, independently and individually control the on/off state and the direction of each said power source, each receiver being adapted to respond to a different coded signal; and (d) a mobile remote transmitter selectively operable to transmit any one of said coded signals to cause a selected one of said receivers to control the connected power sources.

2. A hopper door control apparatus as set forth in claim 1, wherein:

(a) each said power source comprises a reversible electric motor connected to a transmission.

3. A hopper door control apparatus as set forth in claim 1, wherein:

(a) said control signals include IN, OUT, and emergency stop.

4. A hopper door control apparatus as set forth in claim 2, wherein:

(a) the receivers and the motors on all of said plurality of cars receive power from a common generator means.

5. A hopper door control apparatus as set forth in claim 2, wherein:

(a) each of said cars includes a self-contained power source for the corresponding receiver and motors on the car.

6. A hopper door control apparatus as set forth in claim 5, wherein:

(a) said self-contained power sources comprise batteries.

7. A hopper door control apparatus for controlling one or more of a plurality of pivoting discharge control members in corresponding hopper discharge openings on a railroad hopper car, comprising:

(a) a drive shaft extending lengthwise through each said discharge control member at the pivot point;

(b) a transmission means connected to each said drive shaft;

(c) a reversible electromechanical power source connected to each said transmission means and adapted to drive said transmission means in a clockwise or a counter-clockwise direction;

(d) a receiver connected to all of said power sources and adapted to selectively, independently and individually control the switching and direction of each of said power sources in response to uniquely encoded control signals; and (e) a mobile remote transmitter adapted to selectively send said encoded control signals to said receiver.

8. A hopper door control apparatus as set forth in claim 7, wherein:

(a) there are a plurality of railroad cars on a train, each car including a plurality of said hopper discharge openings and pivoting discharge control members, each such car being equipped with one of said receivers;

(b) each receiver being adapted to respond to a different coded receiver selection signal; and (c) said remote transmitter is selectively operable to transmit any one of said coded receiver selection signals along with said control signals to enable a selected one of said receivers.

9. A hopper door control apparatus as set forth in claim 8, wherein:

(a) the receivers and the power sources on all of said plurality of cars receive power from a common generator means.

10. A hopper door control apparatus as set forth in claim 8, wherein:

(a) each of said cars includes a self-contained power source for the corresponding receiver and power sources on the car.

11. A hopper door control apparatus as set forth in claim 10, wherein:

(a) said self-contained power sources comprise batteries.

12. A method of selectively, independently and individually controlling a plurality of pivoting discharge control members positioned in corresponding hopper discharge openings in a railroad hopper car, each said discharge control member being driven by a drive shaft, the method comprising the steps of:

(a) attaching a reversible electromechanical power source to each said drive shaft via a transmission;

(b) connecting a receiver to all of said power sources to selectively, independently and individually control the switching and direction of each of said power sources in response to uniquely encoded control signals; and (c) transmitting said encoded control signals to said receiver from a mobile remote transmitter.

13. The method of claim 12, wherein there are a plurality of hopper cars on a train, each car including a plurality of hoppers, each with a door opening and a pivoting control member, each car also including a respective one of said receivers, said method including the steps of:

(a) adapting each receiver to respond to a unique coded receiver selection signal;

(b) causing said remote transmitter to send a selected one of said receiver selection signals so that a single selected receiver is enabled thereby.

14. A method of selectively controlling one or more of a plurality of pivoting hopper discharge control members on a selected one of a plurality of railroad hopper cars, wherein each said car includes a plurality of hoppers, each with a discharge opening and with a corresponding one of said pivoting discharge control members positioned therein, each said discharge control member being connected to a drive shaft driven by a transmission geared to a reversible electric motor, the method comprising the steps of:

(a) providing a control receiver for each of said cars with each said receiver adapted to respond to a unique address associated with said car and an accompanying set of uniquely encoded motor control signals to selectively, independently and individually control the switching and direction of any of the motors associated with said discharge control members on the associated car; and (b) transmitting said unique address associated with said selected hopper car from a remote transmitter along with said uniquely encoded motor control signals to cause the receiver on said selected car to control said motors on said car.

15. A method as set forth in claim 14, wherein said transmitting step includes:

(a) transmitting said motor control signals including emergency stop, In and Out signals.

16. A method as set forth in claim 14, wherein said transmitting step includes:

(a) transmitting said uniquely encoded motor control signals to said receiver to selectively control said associated motors, either singly or in pairs.

17. A hopper door control apparatus for controlling one or more of a plurality of pivoting discharge control members in corresponding hopper discharge openings on a railroad hopper car, comprising:

(a) a drive shaft extending lengthwise through each said discharge control member at the pivot point;

(b) a transmission means connected to each said drive shaft;

(c) a reversible electromechanical power source connected to each said transmission means and adapted to drive said transmission means in a clockwise or a counter-clockwise direction;

(d) a support plate attached to each said transmission means and said power source;

(e) a support rod pivotally connected at one end to each said support plate and pivotally connected at the opposite end to a frame member of said railroad car;

(f) a receiver connected to all of said power sources and adapted to selectively, independently and individually control the switching and direction of each of said power sources in response to uniquely encoded control signals; and (g) a mobile remote transmitter adapted to send said encoded motor control signals to said receiver.

18. A hopper door control apparatus as set forth in claim 17, wherein:

(a) there are a plurality of railroad cars on a train, each car including at least one of said hopper discharge openings and pivoting discharge control members, each such car being equipped with one of said receivers;

(b) each receiver being adapted to respond to a different coded receiver selection signal; and (c) said remote transmitter is selectively operable to transmit any one of said coded selection signals along with said control signals to enable a selected one of said receivers.

* * * * *